US007972499B2

(12) United States Patent
Chen et al.

(10) Patent No.: US 7,972,499 B2
(45) **Date of Patent: *Jul. 5, 2011**

(54) PROCESS FOR RECYCLING AN ACTIVE SLURRY CATALYST COMPOSITION IN HEAVY OIL UPGRADING

(75) Inventors: Kaidong Chen, Albany, CA (US); Julie Chabot, Novato, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 398 days.

This patent is subject to a terminal disclaimer.

(21) Appl. No.: 12/212,881

(22) Filed: Sep. 18, 2008

(65) Prior Publication Data

US 2009/0050526 A1 Feb. 26, 2009

Related U.S. Application Data

(63) Continuation-in-part of application No. 10/938,438, filed on Sep. 10, 2004, now Pat. No. 7,431,824.

(51) Int. Cl.
*C10G 47/02* (2006.01)

(52) U.S. Cl. ..... 208/108; 208/143; 208/213; 208/254 R

(58) Field of Classification Search ..... None
See application file for complete search history.

(56) References Cited

U.S. PATENT DOCUMENTS 5,371,308 A 12/1944 Gosselink et al.
2,914,462 A * 11/1959 Hemminger ..... 208/112
3,166,493 A * 1/1965 Harvey ..... 208/254 R
3,215,617 A * 11/1965 Van Driesen et al. ..... 208/59
3,817,856 A 6/1974 Aaron et al.
4,259,294 A * 3/1981 Van Zijll Langhout et al. ..... 422/608
4,485,004 A 11/1984 Fisher et al.
4,523,986 A * 6/1985 Seufert ..... 208/390
4,592,827 A 6/1986 Galiasso et al.
4,684,456 A 8/1987 Van Driesen et al.
4,710,486 A 12/1987 Lopez et al.
4,824,821 A 4/1989 Lopez et al.
4,943,547 A 6/1990 Seamans et al.
4,970,190 A 11/1990 Lopez et al.
5,039,392 A 8/1991 Bearden et al.
5,041,404 A 8/1991 Seamans et al.
5,162,282 A 11/1992 Lopez et al.
5,164,075 A 11/1992 Lopez et al.
5,178,749 A 1/1993 Lopez et al.
5,298,152 A 3/1994 Kramer et al.
5,374,348 A 12/1994 Sears et al.
5,484,755 A 1/1996 Lopez et al.
5,527,473 A 6/1996 Ackerman
5,871,638 A 2/1999 Pradhan et al.
5,914,010 A 6/1999 Hood et al.
5,925,238 A 7/1999 Duddy et al.
5,935,418 A 8/1999 Chakrabarty et al.
5,954,945 A 9/1999 Cayton et al.
5,977,192 A 11/1999 Howsmon et al.
6,071,402 A 6/2000 Danot et al.
6,139,723 A * 10/2000 Pelrine et al. ..... 208/422
6,156,693 A 12/2000 Song et al.
6,156,695 A 12/2000 Soled et al.
6,162,350 A 12/2000 Soled et al.
(Continued)

*Primary Examiner* — Tam M Nguyen

(57) ABSTRACT

The instant invention is directed to a process employing slurry catalyst compositions in the upgrading of heavy oils. The slurry catalyst composition is not permitted to settle, which would result in possible deactivation. The slurry is recycled to an upgrading reactor for repeated use and products require no further separation procedures for catalyst removal.

20 Claims, 2 Drawing Sheets

U.S. PATENT DOCUMENTS 6,190,542 B1 * 2/2001 Comolli et al. ..... 208/423
6,241,874 B1 6/2001 Wallace et al.
6,270,654 B1 8/2001 Colyar et al.
6,270,655 B1 * 8/2001 Ganguli ..... 208/85
6,274,530 B1 8/2001 Cayton et al.
6,277,895 B1 8/2001 Zhou et al.
6,278,034 B1 8/2001 Espinoza et al.
6,291,391 B1 9/2001 MacArthur et al.
6,299,760 B1 10/2001 Soled et al.
6,451,729 B1 9/2002 Song et al.
6,534,437 B2 3/2003 Eijsbouts et al.
6,554,994 B1 4/2003 Reynolds et al.
6,620,313 B1 9/2003 Demmin et al.
6,630,066 B2 10/2003 Cash et al.
6,635,599 B1 10/2003 Eijsbouts et al.
6,652,738 B2 11/2003 Eijsbouts et al.
6,660,157 B2 12/2003 Que et al.
6,712,955 B1 3/2004 Hou et al.
6,726,832 B1 4/2004 Baldassari et al.
6,758,963 B1 7/2004 Hantzer et al.
7,150,823 B2 12/2006 Mayer et al.
7,179,366 B2 2/2007 Harle et al.
7,214,308 B2 5/2007 Colyar
7,223,713 B2 5/2007 Alonso et al.
7,232,515 B1 6/2007 Demmin et al.
7,297,250 B2 11/2007 Bronicki
7,358,413 B2 4/2008 Stell et al.
7,413,669 B2 8/2008 Gonzalez et al.
7,416,653 B2 8/2008 Wellington et al.
2002/0010088 A1 1/2002 Eijsbouts et al.
2002/0125172 A1 9/2002 Que et al.
2002/0166797 A1 11/2002 Banerjee
2003/0089636 A1 5/2003 Marchionna et al.
2003/0102254 A1 6/2003 Eijsbouts et al.
2003/0150778 A1 8/2003 Haluska et al.
2004/0134837 A1 7/2004 Dassori et al.
2004/0163999 A1 8/2004 Plantenga et al.
2004/0226860 A1 11/2004 Bourges et al.
2005/0040080 A1 2/2005 Riley et al.
2005/0145538 A1 7/2005 Wellington et al.
2005/0145543 A1 7/2005 Bhan et al.
2005/0150818 A1 7/2005 Bhan et al.
2005/0155908 A1 7/2005 Bhan et al.
2005/0167320 A1 8/2005 Bhan et al.
2005/0167321 A1 8/2005 Wellington et al.
2005/0167322 A1 8/2005 Wellington et al.
2005/0167323 A1 8/2005 Wellington et al.
2005/0167324 A1 8/2005 Bhan et al.
2005/0167326 A1 8/2005 Bhan et al.
2005/0167327 A1 8/2005 Bhan et al.
2005/0167328 A1 8/2005 Bhan et al.
2005/0167329 A1 8/2005 Bhan et al.
2005/0167330 A1 8/2005 Bhan et al.
2005/0167331 A1 8/2005 Bhan et al.
2005/0167332 A1 8/2005 Bhan et al.
2005/0173298 A1 8/2005 Wellington et al.
2005/0173301 A1 8/2005 Bhan et al.
2005/0173302 A1 8/2005 Bhan et al.
2005/0173303 A1 8/2005 Bhan et al.
2005/0241992 A1 11/2005 Lott et al.
2005/0241993 A1 11/2005 Lott et al.
2006/0011511 A1 1/2006 Hokari et al.
2006/0054535 A1 3/2006 Chen et al.
2006/0060501 A1 3/2006 Gauthier et al.
2006/0060502 A1 3/2006 Soled et al.
2006/0060503 A1 3/2006 Soled et al.
2006/0157385 A1 7/2006 Montanari et al.
2006/0163115 A1 7/2006 Montanari et al.
2006/0175229 A1 8/2006 Montanari et al.
2006/0186021 A1 8/2006 Marchionna et al.
2006/0201854 A1 9/2006 Lott et al.
2006/0207917 A1 9/2006 Domokos et al.
2006/0231465 A1 10/2006 Bhan et al.
2006/0272982 A1 12/2006 Montanari et al.
2006/0289340 A1 12/2006 Brownscombe et al.
2007/0000808 A1 1/2007 Bhan et al.
2007/0000810 A1 1/2007 Bhan et al.
2007/0012595 A1 1/2007 Brownscombe et al.
2007/0045156 A1 3/2007 Khadzhiev et al.
2007/0084754 A1 4/2007 Soled et al.
2007/0090023 A1 4/2007 Soled et al.
2007/0090024 A1 4/2007 Soled et al.
2007/0158236 A1 7/2007 Zhou et al.
2007/0158238 A1 7/2007 Wu et al.
2007/0161505 A1 7/2007 Pereira-Almao et al.
2007/0238607 A1 10/2007 Alonso et al.
2007/0284285 A1 12/2007 Stepanik et al.
2007/0295641 A1 12/2007 Brownscombe et al.
2007/0295645 A1 12/2007 Brownscombe et al.
2007/0295646 A1 12/2007 Bhan et al.
2007/0295647 A1 12/2007 Brownscombe et al.
2008/0083650 A1 4/2008 Bhan et al.
2008/0083652 A1 4/2008 Morel et al.
2008/0083655 A1 4/2008 Bhan et al.
2008/0085225 A1 4/2008 Bhan et al.
2008/0087575 A1 4/2008 Bhan et al.
2008/0087578 A1 4/2008 Bhan et al.
2008/0099371 A1 5/2008 McCoy et al.

* cited by examiner

PROCESS FOR RECYCLING AN ACTIVE SLURRY CATALYST COMPOSITION IN HEAVY OIL UPGRADING

CROSS REFERENCE TO RELATED APPLICATIONS

This application is a continuation-in-part of U.S. patent application Ser. No. 10/938,438 with a filing date of Sep. 10, 2004, now U.S. Pat. No. 7,431,824, the disclosure of which is incorporated herein by reference.

FIELD OF THE INVENTION

The present invention relates to a process employing slurry catalyst compositions in the upgrading of heavy oils. These oils are characterized by low hydrogen to carbon ratios and high carbon residues, as well as high asphaltene, nitrogen, sulfur and metal content.

BACKGROUND OF THE INVENTION

Slurry catalyst compositions used in heavy oil upgrading are generally not recycled, due to the particulate size which tends to range from 1 to 20 microns. The processes that attempt to recycle these catalyst particles tend to require multiple steps in the separation and concentration of the catalyst from the final products. The steps used are well known in the refining art. They include but are not limited to the following steps: solvent deasphalting, centrifugation, filtration, settling, distillation, and drying. Other equipment used in these steps may include and is not limited to use of hydrocyclones, extruders, and wiped film evaporators.

These catalyst particles tend to lose catalytic activity during the separation and concentration process steps. This is contrary to the purpose of recycling. This loss of catalytic activity is thought to be due to the precipitation onto the catalysts of polycondensates and coke. Polycondensates and coke are created by temperature and pressure reduction during the steps of catalyst separation and concentration. In slurry catalyst hydroprocessing, the costs of fresh catalyst must be weighed against the costs of catalyst separation, catalyst concentration, and catalyst rejuvenation.

U.S. Pat. No. 5,298,152 teaches recycling to the hydrogenation zone of an active catalyst made from a catalyst precursor, without regeneration or further processing to enhance activity. While it is being separated from the product, the active catalyst is maintained under conditions substantially the same as the conditions encountered in the hydrogenation zone in order to avoid the precipitation of polycondensates and coke. In this way, the catalyst is not quickly deactivated, as often happens when it is separated from the product. Unlike the instant invention, Kramer teaches that a high pressure separator may act as a high pressure settler. In the instant invention, the catalyst is never permitted to settle.

U.S. Pat. No. 5,374,348 teaches a process of hydrocracking of heavy hydrocarbon oils in which the oil is mixed with a fractionated heavy oil recycle stream containing iron sulphate additive particles. The mixture is then passed upwardly through the reactor. Reactor effluent is passed into a hot separator vessel to obtain products and a liquid hydrocarbon stream comprising heavy hydrocarbons and iron sulphate particles. The heavy hydrocarbon stream is further fractionated to obtain a heavy oil boiling above 450° C., which contains the additive particles. This material is recycled back to the hydrocracking reactor.

SUMMARY OF THE INVENTION

In one aspect, the instant invention is directed to a process for hydroconversion of heavy oils, employing an active slurry catalyst composition that is not allowed to settle, comprising the following steps: (a) combining, in an upgrading reactor under hydroprocessing conditions, heavy feed, hydrogen gas, fresh catalyst slurry composition, and recycle slurry composition; (b) passing the effluent of the upgrading reactor to a separation zone wherein products boiling at temperatures up to 900° F. are passed overhead; (c) passing the material remaining in the separation zone from step (b) to a constantly stirred catalyst storage tank; and (d) passing at least a portion of the material in the constantly stirred catalyst storage tank back to the upgrading reactor of step (a).

In another aspect, the instant invention is directed to a process for hydroconversion of heavy oils, employing an active slurry catalyst composition that is not allowed to settle, and wherein the material remaining in the separation zone of step (b) is sent back to the upgrading reactor of step (a) with the use of a recirculation pump, and at least a portion of the material from the separation is diverted as a bleed-off stream.

DETAILED DESCRIPTION OF THE INVENTION

Figure 1:
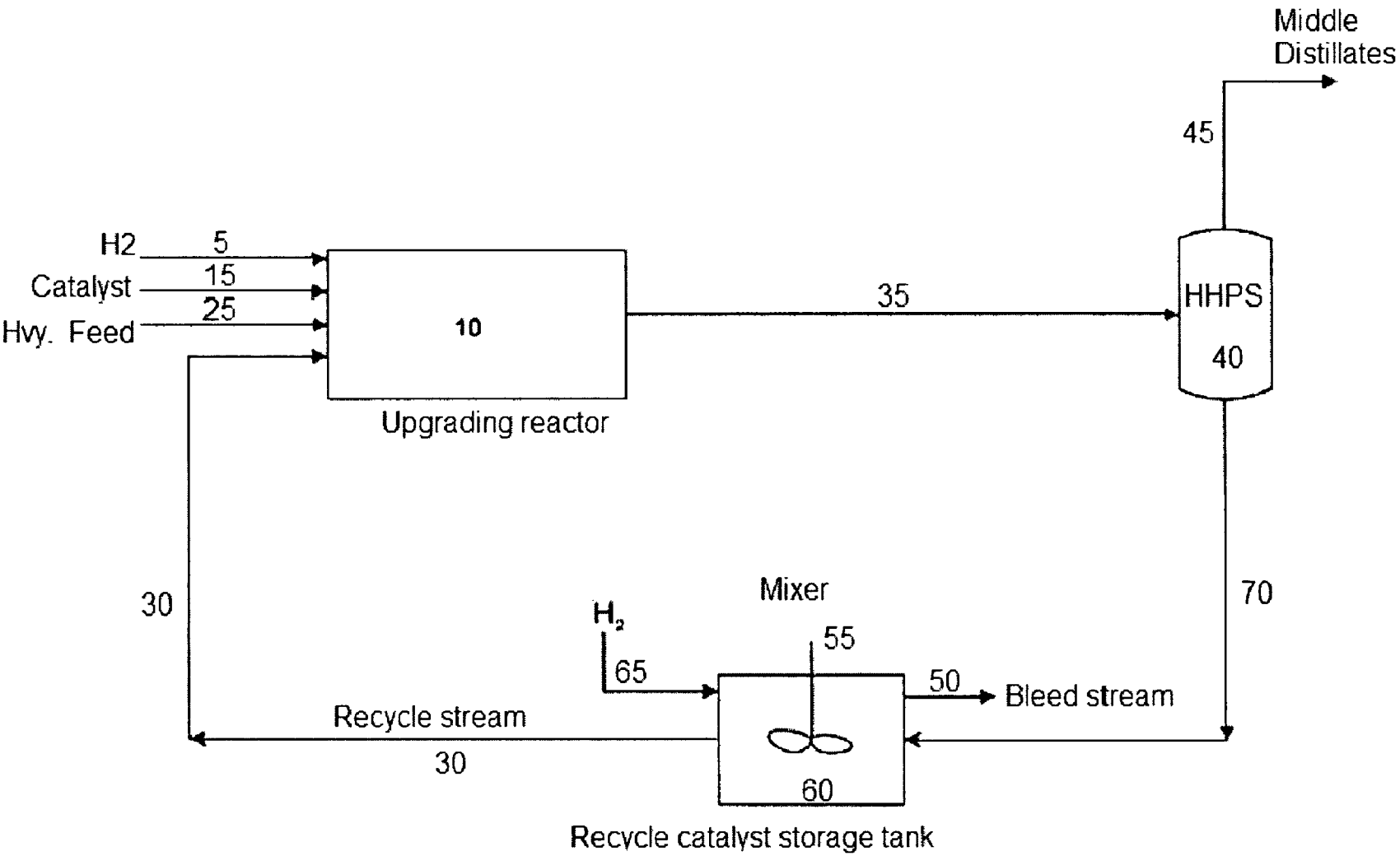
FIG. 1 illustrates one embodiment of the process steps of the instant invention.

In one embodiment, an advantage of the instant invention include prevention of catalyst agglomeration (a source of catalyst deactivation) by not permitting catalyst to settle; removal overhead of middle distillate product from hydrogenation zone (as gas vapor from hot high pressure separator); catalyst-fee product from the hydrogenation zone (no requirement of settling, filtration, centrifugation, etc.); no significant deactivation of catalyst when there is substantial pressure and/or temperature drop due to the very high conversion, up to almost 100% in some embodiments; production in very low amounts of supercondensates (asphaltenes) and coke that do not significantly affect the activity of the catalyst composition; and concentration of catalyst is accomplished in the separation step, no further concentration may be required.

By not allowing/permitting catalyst to settle herein means that the slurry catalyst is intentionally and constantly kept in fluid motion and/or in suspension, and not staying and/or remaining in a particular location in the process. In one embodiment, substantially all of the slurry catalyst is in fluid motion, i.e., not allowed to settle. In another embodiment due to equipment design or operating conditions, e.g., dead space in a reactor or a separator, a minimal amount of slurry catalyst may settle unintentionally or stay stagnant/dormant in place. This amount is insignificant of less than 5 wt. % of total slurry catalyst in one embodiment; less than 2 wt. % in another embodiment, less than 1 wt. % in a third embodiment; less than 0.5 wt. % in a fourth embodiment, and less than 0.25 wt. % in a fifth embodiment.

Active Slurry Catalyst: The slurry catalyst composition is useful for but not limited to hydrogenation upgrading processes such as thermal hydrocracking, hydrotreating, hydrodesulphurization, hydrodenitrification, and hydrodemetalization. The catalyst may be used in processes employing both fixed and ebullated beds.

In one embodiment, the invention is directed to a process for hydroconversion of heavy oils, employing an active slurry catalyst composition such as those disclosed in US Patent Publication Nos. US2007265157, US2006058175, US2007179055 and US2006058174. These applications are incorporated by reference.

In one embodiment, such catalyst compositions comprise a Group VIB metal compound such as molybdenum.

In one embodiment, the slurry catalyst is a multi-metallic catalyst comprising at least a Group VIB metal and optionally, at least a Group VIII metal (as a promoter), wherein the metals may be in elemental form or in the form of a compound of the metal.

In one embodiment, the slurry catalyst is of the formula $(M^t)_a(X^u)_b(S^v)_d(C^w)_e(H^x)_f(O_y)_g(N^z)_h$, wherein M represents at least one group VIB metal, such as Mo, W, etc. or a combination thereof, and X functions as a promoter metal, representing at least one of: a non-noble Group VIII metal such as Ni, Co; a Group VIIIB metal such as Fe; a Group VIB metal such as Cr; a Group IVB metal such as Ti; a Group IIB metal such as Zn, and combinations thereof (X is hereinafter referred to as "Promoter Metal"). Also in the equation, t, u, v, w, x, y, z representing the total charge for each of the component (M, X, S, C, H, O and N, respectively); ta+ub+vd+we+xf+yg+zh=0. The subscripts ratio of b to a has a value of 0 to 5 (0<=b/a<=5). S represents sulfur with the value of the subscript d ranging from (a+0.5b) to (5a+2b). C represents carbon with subscript e having a value of 0to 11(a+b). H is hydrogen with the value of f ranging from 0 to 7(a+b). O represents oxygen with the value of g ranging from 0 to 5(a+b); and N represents nitrogen with h having a value of 0 to 0.5(a+b). In one embodiment, subscript b has a value of 0, for a single metallic component catalyst, e.g., Mo only catalyst (no promoter).

In one embodiment, the slurry catalyst is prepared from a mono-, di, or polynuclear molybdenum oxysulfide dithiocarbamate complex. In a second embodiment, the catalyst is prepared from a molybdenum oxysulfide dithiocarbamate complex.

In one embodiment, the slurry catalyst is a $MoS_2$ catalyst, promoted with at least a group VIII metal compound. In another embodiment, the catalyst is a bulk multimetallic catalyst, wherein said bulk multimetallic catalyst comprises of at least one Group VIII non-noble metal and at least two Group VIB metals and wherein the ratio of said at least two Group VIB metals to said at least one Group VIII non-noble metal is from about 10:1 to about 1:10.

In one embodiment, the slurry catalyst is prepared from catalyst precursor compositions including organometallic complexes or compounds, e.g., oil soluble compounds or complexes of transition metals and organic acids. Examples of such compounds include naphthenates, pentanedionates, octoates, and acetates of Group VIB and Group VII metals such as Mo, Co, W, etc. such as molybdenum naphthanate, vanadium naphthanate, vanadium octoate, molybdenum hexacarbonyl, and vanadium hexacarbonyl.

In one embodiment, the slurry catalyst has an average particle size of at least 1 micron in a hydrocarbon oil diluent. In another embodiment, the slurry catalyst has an average particle size in the range of 1-20 microns. In a third embodiment, the slurry catalyst has an average particle size in the range of 2- 10 microns. In one embodiment, the slurry catalyst has an average particle size ranging from colloidal (nanometer size) to about 1-2 microns. In another embodiment, the catalyst comprises catalyst molecules and/or extremely small particles that are colloidal in size (i.e., less than 100 nm, less than about 10 nm, less than about 5 nm, and less than about 1 nm). In yet another embodiment, the slurry catalyst comprises single layer $MoS_2$ clusters of nanometer sizes, e.g., 5-10 nm on edge.

In one embodiment, a sufficient amount of slurry catalyst is fed to the upgrading reactor for the reactor to have a slurry (solid) catalyst concentration ranging from 2 to 30 wt. %. In a second embodiment, the (solid) catalyst concentration in the reactor ranges from 3 to 20 wt. %. In a third embodiment, from 5 to 10 wt. %.

In one embodiment, the amount of slurry catalyst feed into the upgrading reactor ranges about 100 to 20,000 ppm expressed as weight of group VIB metal to weight of heavy oil feedstock. In another embodiment, the concentration of slurry catalyst in the heavy oil ranges from 50 to 15000 wppm of Mo (concentration in heavy oil feed). In yet another embodiment, the concentration of the slurry catalyst feed ranges from 150 to 2000 wppm Mo. In a fourth embodiment, from 250 to 5000 wppm Mo. In a fifth embodiment, the concentration is less than 10,000 wppm Mo.

Heavy Oils: The slurry catalyst composition is useful for upgrading heavy oils. As used herein, heavy oils refer to carbonaceous feedstocks, which include atmospheric gas oils, vacuum gas oils, deasphalted oils, olefins, oils derived from tar sands or bitumen, oils derived from coal, heavy crude oils, synthetic oils from Fischer-Tropsch processes, and oils derived from recycled oil wastes and polymers. Heavy oils may be used interchangeably with heavy oil feed or heavy oil feedstock.

Upgrading Reactor: As used herein, the term "upgrading reactor" refers to an equipment in which the heavy oils feed is treated or upgraded by contact with a slurry catalyst feed in the presence of hydrogen. In an upgrading reactor, at least a property of the crude feed may be changed or upgraded. The term "upgrading reactor" as used herein can refer to a reactor, a portion of a reactor, a plurality of reactors in series, multiple portions of a reactor, or combinations thereof. The term "upgrading reactor" may be used interchangeably with "contacting zone." In one embodiment, the upgrading reactor provides a residence time ranging from 0.1 to 15 hours. In a second embodiment, the resident time ranges from 0.5 to 5 hrs. In a third embodiment, the residence time ranges from 0.2 to 2 hours.

In one embodiment, the process comprises a plurality of upgrading reactors, with the reactors being the same or different in configurations. Examples of reactors that can be used herein include stacked bed reactors, fixed bed reactors, ebullating bed reactors, continuous stirred tank reactors, fluidized bed reactors, spray reactors, liquid/liquid contactors, slurry reactors, liquid recirculation reactors, and combinations thereof. In one embodiment, the reactor is an up-flow reactor. In another embodiment, a down-flow reactor. In one embodiment, the upgrading reactor comprises a slurry-bed hydrocracking reactor in series with at least a fixed bed hydrotreating reactor.

Hot Pressure Separator: The term "hot pressure separator" may be used interchangeably with "separation zone," referring to an equipment in which effluents from an upgrading director is either fed directly into, or subjected to one or more intermediate processes and then fed directly into the hot pressure separator, e.g., a flash drum or a high pressure separator, wherein gases and volatile liquids are separated from the non-volatile fraction. In one embodiment, the non-volatile fraction stream comprises unconverted heavy oil feed, a small amount of heavier hydrocracked liquid products (synthetic or less-volatile/non-volatile upgraded products), the slurry catalyst and any entrained solids (asphaltenes, coke, etc.).

Bleed Stream: The term "bleed stream" or "bleed off stream" refers to a stream containing recycled catalyst, being "bled" or diverted from the process, helping to prevent or "flush" accumulating metallic sulfides and other unwanted impurities from the upgrade system. In one embodiment, the bleed stream ranges from any of 0.30 to 25 wt. %; 1-30 wt. %; or 0.5 to 15 wt. % of the heavy oil feed.

Process Conditions: In one embodiment, the hydroconversion process has a plurality of upgrading reactors, with the process condition being controlled to be more or less uniformly across the contacting zones. In another embodiment, the condition varies between the upgrading reactors for upgrade products with specific properties.

In one embodiment, the process conditions are maintained under hydrocracking conditions, i.e., at a minimum temperature to effect hydrocracking of a heavy oil feedstock. In one embodiment, at a temperature of 410° C. to 600° C., at a pressure ranging from 10 MPa to 25 MPa.

In one embodiment, the upgrading reactor process temperature ranges from about 410° C. (770° F.) to about 600° C. (1112° F.) in one embodiment, less than about 462° C. (900° F.) in another embodiment, more than about 425° C. (797° F.) in another embodiment. In one embodiment, the temperature difference between the inlet and outlet of an upgrading reactor ranges from 5 to 50° F. In a second embodiment, from 10 to 40° F.

In one embodiment, the temperature of the separation zone is maintained within ±90° F. (about ±50° C.) of the upgrading reactor temperature in one embodiment, within ±70° F. (about +38.9° C.) in a second embodiment, and within ±15° F. (about ±8.3° C.) in a third embodiment, and within ±5° F. (about ±2.8° C.). In one embodiment, the temperature difference between the last separation zone and the immediately preceding upgrading reactor is within ±50° F. (about ±28° C.).

In one embodiment, the pressure of the separation zone is maintained within ±10 to ±50 psi of the preceding upgrading reactor in one embodiment, and within ±2 to ±10 psi in a second embodiment.

In one embodiment, the process pressure may range from about 5 MPa (1,450 psi) to about 25 MPa (3,625 psi), about 15 MPa (2,175 psi) to about 20 MPa (2,900 psi), less than 22 MPa (3,190 psi), or more than 14 MPa (2,030 psi).

In one embodiment, the liquid hourly space velocity (LHSV) of the heavy oil feed will generally range from about 0.025 $h^{-1}$ to about 10 $h^{-1}$, about 0.5 $h^{-1}$ to about 7.5 $h^{-1}$, about 0.1 $h.^{-1}$ to about 5 $h^{-1}$, about 0.75 $h^{-1}$ to about 1.5 $h^{-1}$, or about 0.2 $h^{-1}$ to about 10 $h^{-1}$. In some embodiments, LHSV is at least 0.5 $h^{-1}$, at least 1 $h^{-1}$, at least 1.5 $h^{-1}$, or at least 2 $h\text{-}^{-1}$. In some embodiments, the LHSV ranges from 0.025 to 0.9 $h^{-1}$. In another embodiment, the LHSV ranges from 0. 1 to 3 LHSV. In another embodiment, the LHSV is less than 0.5 $h^{-1}$.

Hydrogen Feed: In one embodiment, the hydrogen source is provided to the process at a rate (based on ratio of the gaseous hydrogen source to the heavy oil feed) of 0.1 $Nm^3/m^3$to about 100,000 $Nm^3/m^3$ (0.563 to 563,380 SCF/bbl), about 0.5 $Nm^3/m^3$ to about 10,000 $Nm^3/m^3$ (2.82 to 56,338 SCF/bbl), about 1 $Nm^3/m^3$ to about 8,000 $Nm^3/m^3$ (5.63 to 45,070 SCF/bbl), about 2 $Nm^3/m^3$ to about 5,000 $Nm^3/m^3$ (11.27 to 28,169 SCF/bbl), about 5 $Nm^3/m^3$ to about 3,000 $Nm^3/m^3$ (28.2 to 16,901 SCF/bbl), or about 10 $Nm^3/m^3$ to about 800 $Nm^3/m^3$ (56.3 to 4,507 SCF/bbl). In one embodiment, some of the hydrogen (25-75%) is supplied to the first upgrading reactor, and the rest is added as supplemental hydrogen to other upgrading reactors in system.

In one embodiment, the upgrade system produces a volume yield of least 110% (compared to the heavy oil feed) in upgraded products as added hydrogen expands the heavy oil total volume. The upgraded products, i.e., lower boiling hydrocarbons, in one embodiment include liquefied petroleum gas (LPG), gasoline, diesel, vacuum gas oil (VGO), and jet and fuel oils. In a second embodiment, the upgrade system provides a volume yield of at least 115% in the form of LPG, naphtha, jet & fuel oils, and VGO.

In one embodiment of the upgrade system, at least 98 wt % of heavy oil feed is converted to lighter products. In a second embodiment, at least 98.5% of heavy oil feed is converted to lighter products. In a third embodiment, the conversion rate is at least 99%. In a fourth embodiment, the conversion rate is at least 95%. In a fifth embodiment, the conversion rate is at least 80%. As used herein, conversion rate refers to the conversion of heavy oil feedstock to less than 1000° F. (538° C.) boiling point materials.

Figures Illustrating Embodiments: Reference will be made to the figures to further illustrate embodiments of the invention. In one embodiment, the process can be operated in either one or two stage modes.

In FIG. 1, the upgrading reactor 10 represents only the first stage. The second stage (if present), which may be an integrated hydrotreater, is not shown. In one-stage operation, the heavy oil feed (line 25) is contacted with the active catalyst slurry and a hydrogen-containing gas (line 5) at elevated temperatures and pressures in continuously stirred tank reactors or ebullated bed catalytic reactors. In one embodiment, the active catalyst slurry is composed of up to 95 wt % recycle material (line 30) and 5 wt. % fresh catalyst (line 15). The feed, catalyst slurry and hydrogen-containing gas are mixed in upgrading reactor 10 at a residence time and temperature sufficient to achieve measurable thermal cracking rates.

The effluent from the upgrading reactor 10 passes through line 35 to the hot high pressure separator 40. The resultant light oil is separated from solid catalyst and unconverted heavy oil in the hot high pressure separator 40, and passes through line 45 to middle distillate storage. Alternately, the light oil may be sent to the second-stage reactor (not shown). This reactor is typically a fixed bed reactor used for hydrotreating of oil to further remove sulfur and nitrogen, and to improve product qualities. The product is free of catalyst and does not require settling, filtration, centrifugation, etc.

In the hot high pressure separator 40, substantially all of the upgraded products generated from the heavy oil hydroconversion upgrading zone 10 goes overhead as gas-vapor stream 45. In one embodiment, at least 50 wt % of the upgraded products boils in the range between 180° F. and 650° F.

The liquid in the bottom of the hot high pressure separator 40, composed primarily of unconverted oil, heavier hydrocracked liquid products, active catalyst, small amounts of coke, asphaltenes, etc., is passed through line 70 to the recycle catalyst storage tank 60. This tank is constantly stirred, as depicted by Mixer 55, and a constant reducing atmosphere is maintained by the addition of hydrogen (line 65). Excess hydrogen may be removed by bleed stream 50. In one embodiment, the bleed stream ranges from 1-30 wt. of the heavy oil feed. In another embodiment, the bleed stream ranges from 0.5 to 15 wt. % of the heavy oil feed.

In one embodiment, the liquid in the bottom of the hot high pressure separator contains between 3 to 30 wt. % slurry catalyst. In another embodiment, the catalyst amount ranges from 5 to 20 wt. % . In yet another embodiment, the liquid in the bottom of the hot high pressure separator contains 1 to 15 wt. % slurry catalyst.

The catalyst slurry is recycled back to upgrading reactor 10 as needed (through line 30). Recycle makes up can be as high as 95 wt % of the catalyst used in the upgrading reactor. In one embodiment, the recycled stream ranges between 3 to 50 wt. % of total heavy oil feedstock to the process. In a second embodiment, the recycled stream is in an amount ranging from 5 to 35 wt. % of the total heavy oil feedstock to the system. In a fourth embodiment, the recycled stream is at least 10 wt. % of the total heavy oil feedstock to the system. In a fifth embodiment, the recycled stream is 15 to 35 wt. % of the total heavy oil feed. In a sixth embodiment, the recycled stream is at least 35 wt. %. In a seventh embodiment, the recycled stream ranges between 40 to 50 wt. %. In an eight embodiment, the recycled is of a sufficient amount for the process to have a conversion rate of at least 99%.

The catalyst activity is maintained by running the upgrading process near 100% conversion, maintaining an at least minimum reducing atmosphere throughout the upgrading, separation and storage, and not allowing the catalyst composition to settle at any time. Following the separation in the hot high pressure separator, there is no need for further separation steps. Throughout the process, substantial temperature and pressure fluctuations are tolerated with only minor precipitate formation of supercondensates and coke. In past processes in which recycle has been employed, the slurry catalyst composition has sustained substantial fouling and deactivation.

In one embodiment, for the first-stage operation as depicted in upgrading reactor 10, the temperatures for heavy oil feedstocks are normally above about 700° F., preferably above 750° F., and most preferably above 800° F. in order to achieve high conversion. Hydrogen partial pressures range from 350 to 4500 psi and hydrogen to oil ratio is from 500 to 10,000 SCFB. The concentration of the active slurry catalyst in the heavy oil is normally from about 100 to 20,000 ppm expressed as weight of metal (molybdenum) to weight of heavy oil feedstock. Typically, higher catalyst to oil ratio will give higher conversion for sulfur, nitrogen and metal removal, as well as the higher cracking conversion. The high pressure separator temperature can be as high as 800° F. Near 100% demetalation conversion and 1000° F.+cracking conversion of the heavy oil can be achieved at appropriate process conditions, while the coke yield can be maintained at less than about 1%.

The process conditions for the second-stage (not shown in the Figure) are typical of heavy oil hydrotreating conditions. The second-stage reactor may be either a fixed, ebullated or a moving bed reactor. The catalyst used in the second-stage reactor is a hydrotreating catalyst such as those containing a Group VIB and/or a Group VIII metal deposited on a refractory metal oxide. By using this integrated hydrotreating process, the sulfur and nitrogen content in the product oil can be very low, and the product oil qualities are also improved.

Figure 2:
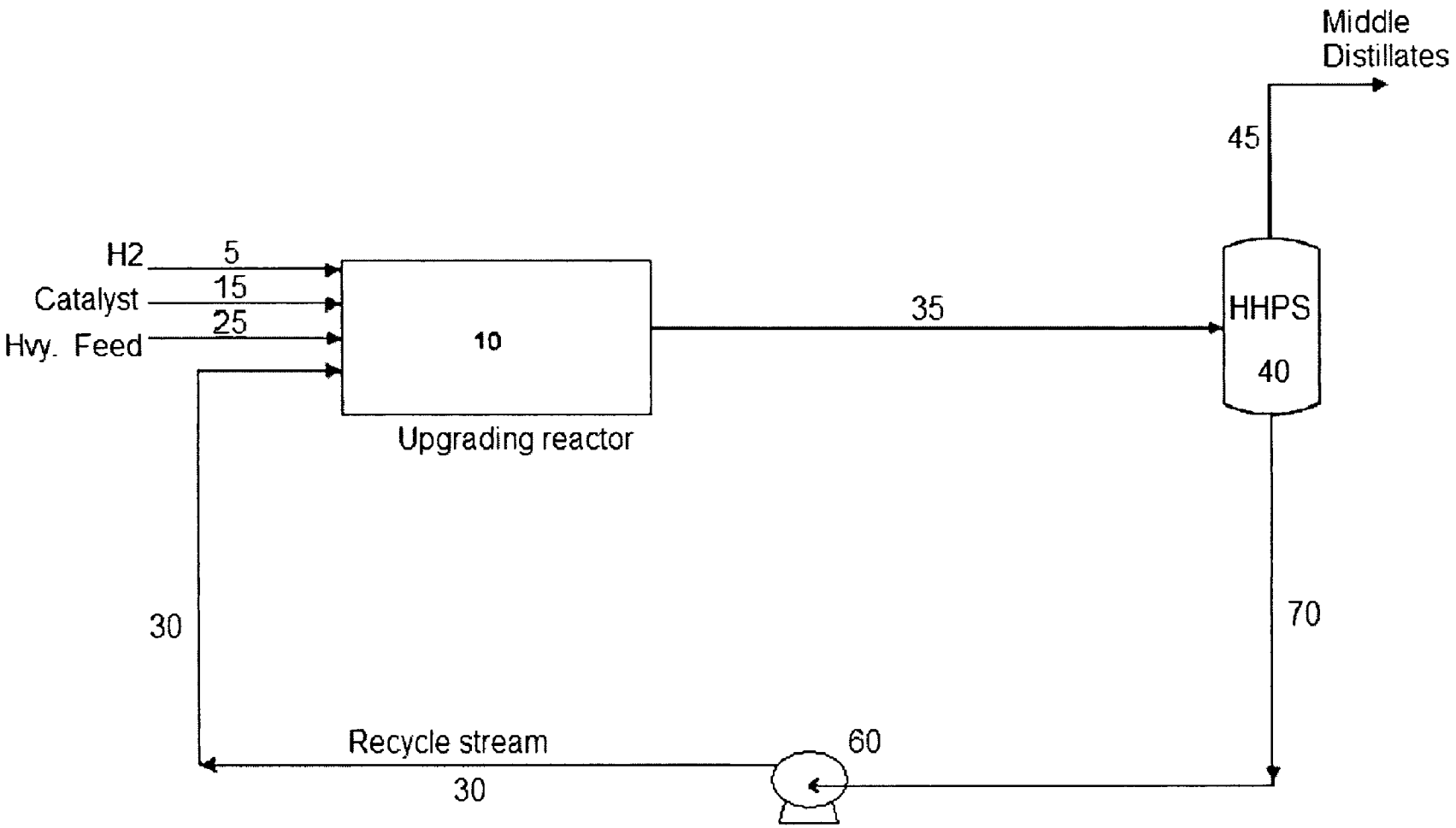
FIG. 2 illustrates a second embodiment of the process steps, wherein a circulation pump is employed to send the materials back to the upgrading reactor and not allowing the catalyst to settle.

In one embodiment, instead of or in addition to a constantly stirred storage tank 60, an in-line mixing apparatus is used to keep the slurry catalyst to be constantly in motion, i.e., not allowed to settle. In yet another embodiment as illustrated in FIG. 2, a pump 60 is used to pass the recycled stream 30 back to upgrading reactor 10 as needed without the use of a constant stirred storage tank, help keeping the catalyst in constant motion, i.e., not allowed to settle.

EXAMPLES

Example 1

This example depicts heavy oil upgrading (Athabasca vacuum residuum) in recycle mode. The catalyst is activated by using a method similar to methods disclosed in US Patent Publication Nos. US2006058174 and US2007179055 (T-6393). This catalyst is activated using only a single oil.

The prepared slurry catalyst was used for Athabasca vacuum resid (VR) and vacuum gas oil (VGO) feed upgrading in a process unit which employed two continuously stirred tank reactors. Catalyst was recycled with unconverted heavy oil. A feed blend with 97% Athabasca VR and 3% Athabasca VGO was used.

The Athabasca VR feed properties are listed in the following table:

| | |
|---|---|
| API gravity at 60/60 | 3.9 |
| Sulfur (wt %) | 5.58 |
| Nitrogen (ppm) | 5770 |
| Nickel (ppm) | 93 |
| Vanadium (ppm) | 243 |
| Carbon (wt %) | 83.57 |
| Hydrogen (wt %) | 10.04 |
| MCRT (wt %) | 17.2 |
| Viscosity @ 212° F. (cSt) | 3727 |
| Pentane Asphaltenes (wt %) | 13.9 |
| Fraction Boiling above 1050° F. (wt %) | 81 |

The Athabasca VGO feed properties are listed in the following table:

| | |
|---|---|
| API gravity at 60/60 | 15.6 |
| Sulfur (wt %) | 3.28 |
| Nitrogen (ppm) | 1177 |
| Carbon (wt %) | 85.29 |
| Hydrogen (wt %) | 11.01 |
| MCRT (wt %) | 0.04 |
| Fraction Boiling above 650° F. (wt %) | 85 |

The process conditions used for the heavy oil upgrading is listed as following:

| | |
|---|---|
| Total pressure (psig) | 2500 |
| Fresh Mo/Fresh Oil ratio (%) | 0.24 |
| Fresh Mo/Total Mo ratio | 0.1 |
| Fresh oil/Total oil ratio | 0.75 |
| Total feed LHSV | 0.21 |
| Reactor temperature (° F.) | 825 |
| $H_2$ gas rate (SCF/B) | 9100 |

The product yields, properties and conversion are listed in the following table:

| | |
|---|---|
| C4- gas (wt %) | 12.1 |
| C5-180° F. (wt %) | 7.5 |
| 180-350° F. (wt %) | 15.5 |
| 350-500° F. (wt %) | 20.8 |
| 500-650° F. (wt %) | 22.2 |
| 650-800° F. (wt %) | 14.8 |
| 800-1000° F. (wt %) | 3.9 |
| 1000° F.+ (wt %) | 0.3 |
| HDN conversion (%) | 62 |
| HDS conversion (%) | 94 |
| HDM conversion (%) | 99 |
| Liquid product API gravity | 33 |

Middle distillates compose 58.5 wt % of the product and heteroatom content is drastically reduced.

Example 2

This example depicts heavy oil upgrading (Hamaca vacuum residuum) in recycle mode. The catalyst is also activated by using a method similar to methods disclosed in US Patent Publication Nos. US2006058174 and US2007179055. This catalyst is activated using only a single oil.

The prepared slurry catalyst was used for Hamaca vacuum resid (VR) and vacuum gas oil (VGO) feed upgrading in a process unit which contains two continuously stirred tank reactors, and a recycle portion which enables recycling catalyst with unconverted heavy oil. A feed blend with 90% Hamaca VR and 10% Hamaca VGO was used.

The Hamaca VR feed properties are listed in the following table:

| | |
|---|---|
| API gravity at 60/60 | 1.7 |
| Sulfur (wt %) | 4.56 |
| Nitrogen (ppm) | 9222 |
| Nickel (ppm) | 168 |
| Vanadium (ppm) | 714 |
| Carbon (wt %) | 83.85 |
| Hydrogen (wt %) | 9.46 |
| Viscosity @ 266° F. (cSt) | 19882 |
| Pentane Asphaltenes (wt %) | 32 |
| Fraction Boiling above 1050° F. (wt %) | 91 |

The Hamaca VGO feed properties are listed in the following table:

| | |
|---|---|
| API gravity at 60/60 | 14.2 |
| Sulfur (wt %) | 3.53 |
| Nitrogen (ppm) | 2296 |
| Carbon (wt %) | 84.69 |
| Hydrogen (wt %) | 11.58 |
| Fraction Boiling above 650° F. (wt %) | 89 |

The process conditions used for the heavy oil upgrading is listed as following:

| | |
|---|---|
| Total pressure (psig) | 2600 |
| Fresh Mo/Fresh Oil ratio (%) | 0.55 |
| Fresh Mo/Total Mo ratio | 0.25 |
| Fresh oil/Total oil ratio | 0.75 |
| Total feed LHSV | 0.16 |
| Reactor temperature (° F.) | 825 |
| H2 gas rate (SCF/B) | 9400 |

The product yields, properties and conversion are listed in the following table:

| | |
|---|---|
| C4- gas (wt %) | 14 |
| C5-180° F. (wt %) | 6.6 |
| 180-350° F. (wt %) | 15.4 |
| 350-500° F. (wt %) | 21.1 |
| 500-650° F. (wt %) | 22.4 |
| 650-800° F. (wt %) | 12.6 |
| 800-1000° F. (wt %) | 4 |
| 1000° F.+ (wt %) | 1.5 |
| HDN conversion (%) | 63 |
| HDS conversion (%) | 96 |
| HDM conversion (%) | 99 |
| Liquid product API gravity | 33 |

Middle distillates compose 58.9 wt % of the product and heteroatom content is drastically reduced.

For the purpose of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that may vary depending upon the desired properties sought to be obtained and/or the precision of an instrument for measuring the value, thus including the standard deviation of error for the device or method being employed to determine the value. The use of the term "or" in the claims is used to mean "and/or" unless explicitly indicated to refer to alternatives only or the alternative are mutually exclusive, although the disclosure supports a definition that refers to only alternatives and "and/or." The use of the word "a" or "an" when used in conjunction with the term "comprising" in the claims and/or the specification may mean "one," but it is also consistent with the meaning of "one or more," "at least one," and "one or more than one." Furthermore, all ranges disclosed herein are inclusive of the endpoints and are independently combinable. In general, unless otherwise indicated, singular elements may be in the plural and vice versa with no loss of generality. As used herein, the term "include" and its grammatical variants are intended to be non-limiting, such that recitation of items in a list is not to the exclusion of other like items that can be substituted or added to the listed items.

It is contemplated that any aspect of the invention discussed in the context of one embodiment of the invention may be implemented or applied with respect to any other embodiment of the invention. Likewise, any composition of the invention may be the result or may be used in any method or process of the invention. This written description uses examples to disclose the invention, including the best mode, and also to enable any person skilled in the art to make and use the invention. The patentable scope is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims. All citations referred herein are expressly incorporated herein by reference.

What is claimed is:

1. A process for upgrading heavy oils which employs a slurry catalyst composition, the process comprising:

(a) combining, in an upgrading reactor under hydroprocessing conditions, heavy oil feed, hydrogen gas, fresh catalyst slurry composition, and recycle slurry composition, and wherein under hydroprocessing conditions at least a portion of the heavy oil feedstock is converted to lower boiling hydrocarbons, forming upgraded products;

(b) passing an effluent flow from the upgrading reactor to a separation zone wherein upgraded products boiling at temperatures up to 900° F. are passed overhead;

(c) passing materials remaining in the separation zone from step (b) to a constantly stirred catalyst storage tank; and (d) passing at least a portion of the materials in the constantly stirred catalyst storage tank back to the upgrading reactor of step (a);

wherein the slurry catalyst composition is not allowed to settle in the process and wherein the slurry catalyst has an average particle size in the range of 1-20 microns.

2. The process of claim 1, further comprising removing at least a portion of the material in the constantly stirred catalyst storage tank from the process as a bleed-stream.

3. The process of claim 2, wherein the bleed-stream ranges from 1-30 wt. % of the heavy oil feed.

4. The process of claim 3, wherein the bleed-stream ranges from 0.5 to 15 wt. % of the heavy oil feed.

5. The process of claim 1, wherein the materials from the constantly stirred catalyst storage tank contains between 3 to 30 wt. % slurry catalyst.

6. The process of claim 1, wherein the materials from the constantly stirred catalyst storage tank contains between 1 to 15 wt. % slurry catalyst.

7. The process of claim 1, wherein the at least a portion of the materials in the constantly stirred catalyst storage tank is passed to the upgrading reactor of step (a) using a pump.

8. A process for upgrading heavy oils which employs a slurry catalyst composition, the process comprising:

(a) combining, in an upgrading reactor under hydroprocessing conditions, heavy oil feed, hydrogen gas, fresh catalyst slurry composition, and recycle slurry composition, and wherein under hydroprocessing conditions at least a portion of the heavy oil feedstock is converted to lower boiling hydrocarbons, forming upgraded products;

(b) passing an effluent flow from the upgrading reactor to a separation zone wherein upgraded products boiling at temperatures up to 900° F. are passed overhead;

(c) pumping at least a portion of materials remaining in the separation zone from step (b) back to the upgrading reactor of step (a); and (d) removing at least a portion of the materials remaining in the separation zone as a bleed stream;

wherein the slurry catalyst composition is not allowed to settle in the process and wherein the slurry catalyst has an average particle size in the range of 1-20 microns.

9. The process of claim 8, wherein the heavy oil feed is selected from the group consisting of atmospheric gas oils, vacuum gas oils, deasphalted oils, olefins, oils derived from tar sands or bitumen, oils derived from coal, heavy crude oils, synthetic oils from Fischer-Tropsch processes, and oils derived from recycled oil wastes and polymers.

10. The process of claim 8, wherein the upgrading process is selected from the group consisting of thermal hydrocracking, hydrotreating, hydrodesulphurization, hydrodenitrification, and hydrodemetalization.

11. The process of claim 8, wherein the separation zone is a hot high pressure separator.

12. The process of claim 8, wherein at least 50 wt % of the upgraded products boil in the range between 180° F. and 650° F.

13. The process of claim 8, wherein the upgrading reactor is one of a constant stirred tank reactor, a moving bed reactor, an ebullated bed reactor, and a fixed bed reactor.

14. The process of claim 8, wherein the recycle slurry catalyst composes up to 95 wt % of the slurry catalyst used in the upgrading reactor.

15. The process of claim 8, wherein hydroprocessing conditions comprise temperatures greater than 750° F., hydrogen partial pressures in the range from 350 to 4500 psi, and a hydrogen to oil ratio in the range from 500 to 10,000 SCFB.

16. The process of claim 8, wherein the concentration of active slurry catalyst in the heavy oil ranges from about 100 to 20,000 ppm expressed as weight of group VIB metal to weight of heavy oil feedstock.

17. The process of claim 8, wherein the bleed stream ranges from 1-30 wt. % of the heavy oil feed.

18. The process of claim 8, wherein the bleed stream is of an amount sufficient for the process to have a conversion rate of at least 99%.

19. The process of claim 8, wherein the materials remaining in the separation zone from step (b) comprises 3 to 30 wt. % slurry catalyst.

20. The process of claim 18, wherein the materials remaining in the separation zone from step (b) comprises 5 to 20 wt. % slurry catalyst.

* * * * *